US008282434B2

(12) United States Patent
Kumano

(10) Patent No.: US 8,282,434 B2
(45) Date of Patent: Oct. 9, 2012

(54) FIN

(76) Inventor: Katsuyoshi Kumano, Tokyo (JP)

( * ) Notice: Subject to any disclaimer, the term of this patent is extended or adjusted under 35 U.S.C. 154(b) by 0 days.

(21) Appl. No.: 12/746,644

(22) PCT Filed: Dec. 11, 2007

(86) PCT No.: PCT/JP2007/073872
§ 371 (c)(1),
(2), (4) Date: Oct. 13, 2010

(87) PCT Pub. No.: WO2009/075026
PCT Pub. Date: Jun. 18, 2009

(65) Prior Publication Data

US 2011/0028058 A1 Feb. 3, 2011

(51) Int. Cl.
*B63B 35/79* (2006.01)

(52) U.S. Cl. ..... 441/79

(58) Field of Classification Search ..... 441/79; 114/39.15
See application file for complete search history.

(56) References Cited

U.S. PATENT DOCUMENTS 4,398,485 A * 8/1983 Diziere ..... 114/132
2005/0064775 A1 3/2005 White

FOREIGN PATENT DOCUMENTS

JP 58-46972 3/1983
JP 2000-323529 11/2000
JP 2002-172557 6/2002
JP 2006-280839 10/2006
JP 2008-049758 3/2008

OTHER PUBLICATIONS

International Search Report for PCT/JP2007/073872, mailed Mar. 18, 2008.
Microfilm of the Specification and drawings annexed to the request of JP No. 1980-49230 (Laid-open No. 1981-150579), (Nov. 11, 1981).

* cited by examiner

*Primary Examiner* — Edwin Swinehart
(74) *Attorney, Agent, or Firm* — Nixon & Vanderhye P.C.

(57) ABSTRACT

An object of the present invention is to provide fin in which the fin can be easily attached or detached to a board, its attached state can be maintained well, and the fin readily comes off in an emergency such as when the fin is brought into contact with human body.
Furthermore, it is an object of the present invention to allow the reduction of rattle when the fin is attached.
To solve such problems, provided is a fin, comprising a hollow part at a side surface of an attachment base portion of the fin to be attached to a groove in a bottom surface of a surfboard,
wherein a ball part is biased outwardly of the hollow part by an elastic member in the hollow part; and
wherein the ball part in the hollow part of the attachment base portion of the fin is moved into the hollow part against a biasing force from the elastic member, and thus the fin is detachably mounted in the attachment groove of this board under elastic compression force.

18 Claims, 11 Drawing Sheets

FIN

This application is the U.S. national phase of International Application No. PCT/JP2007/073872 filed 11 Dec. 2007, which designated the U.S., the entire content of which is hereby incorporated by reference.

TECHNICAL FIELD

The present invention relates to a surfboard fin and, more specifically, to a fin that can be detachably attached to the surfboard, the fin readily coming off the surfboard in an emergency such as when the fin strikes a human body.

BACKGROUND

Conventionally, there have been roughly two types of fin attachment structures for surfboards, namely a fixed fin type, and a detachable fin type.

As compared to the fixed fin type the detachable fin type is used more frequently and there are various attachment structures because it allows the attachment of a fin in an arbitrary shape according to a user's preference. In addition, the fin can be detached and carried.

That is, an embedded fin box and the like are pre-arranged on the bottom surface of a surfboard. The fin is then detachably mounted in the fin box.

One prior disclosure of screw fixing as structures that allow a fin to be detachable when the fin is broken or carried include those disclosed in Japanese Unexamined Patent Publication (Kokai) No. H6-255575 (patent document 1), Translated Japanese Publication of Patent Application No. 2001-520961 (patent document 2), Translated Japanese Publication of Patent Application No. 2002-530242 (patent document 3), and Japanese Unexamined Patent Publication (Kokai) No. 2003-306195 (patent document 4).

These prior disclosures have a structure in which screws, bolts or the like are used to fasten a fin for fixing the fin to the fin box.

In addition to the above, structures in which grooves having various structures are provided in the fin box and the fin is fastened by fitting the fin into a groove include those disclosed in Japanese Unexamined Patent Publication (Kokai) No. 2005-74026 (patent document 5), Japanese Unexamined Patent Publication (Kokai) No. 2005-112206 (patent document 6), and Japanese Unexamined Patent Publication (Kokai) No. 2006-280839 (patent document 7).

Furthermore, a structure in which the fin is fastened using a C-shaped clamp, there is disclosed in Translated Japanese Publication of Patent Application No. 2003-528003 (patent document 8).

Structures in which the fin is fastened so that it can be attached detachably using a special locking member include those disclosed in Translated Japanese Publication of Patent Application No. 2005-508798 (patent document 9) and Translated Japanese Publication of Patent Application No. 2005-526664 (patent document 10).

Furthermore, a structure in which both the fin box and the fin fitted therein have a fitting structure in a special shape such that the fin is fastened detachably, is disclosed in Japanese Unexamined Patent Publication (Kokai) No. 2007-160969 (patent document 11).

Patent document 1: Japanese Unexamined Patent Publication No. H6-255575

Patent document 2: Translated Japanese Publication of Patent Application No. 2001-520961

Patent document 3: Translated Japanese Publication of Patent Application No. 2002-530242

Patent document 4: Japanese Unexamined Patent Publication (Kokai) No. 2003-306195

Patent document 5: Japanese Unexamined Patent Publication (Kokai) No. 2005-74026

Patent document 6: Japanese Unexamined Patent Publication (Kokai) No. 2005-112206

Patent document 7: Japanese Unexamined Patent Publication (Kokai) No. 2006-280839

Patent document 8: Translated Japanese Publication of Patent Application No. 2003-528003

Patent document 9: Translated Japanese Publication of Patent Application No. 2005-508798

Patent document 10: Translated Japanese Publication of Patent Application No. 2005-526664

Patent document 11: Japanese Unexamined Patent Publication (Kokai) No. 2007-160969

As described above, there exist various attachment structures for attaching a fin of a surfboard.

For example, the structure disclosed in Japanese Unexamined Patent Publication No. H6-255575 adopts so-called screw fixing, in which a screw is tightened to fix the fin, or the fin can be detached by unscrewing the screw.

Because of this, attachment and detachment of the fin require a special tool, such as a screwdriver.

Furthermore, for example, when the fin comes into contact with human in use, the fin will remain fastened and human body may be injured. That is, it is unlikely that the fin will separate from the board to prevent the fin from injuring the human in such an emergency.

Next, in the structures disclosed in Japanese Publication of Patent Application No. 2001-520961, Japanese Publication of Patent Application No. 2002-530242, and Japanese Unexamined Patent Publication (Kokai) No. 2003-306195, a fin is fastened by screws in a transverse direction. Detachment of the fin similarly requires a special tool such as a screwdriver. Thus, for example, even if the surfer falls during surfing and the fin of the surfboard comes into contact with a human body, the fin will remain fastened to the board. There is thus a possibility that the fin may inure the human body.

Further, the structures shown in Japanese Unexamined Patent Publication (Kokai) No. 2005-74026 and Japanese Unexamined Patent Publication (Kokai) No. 2005-112206 are those in which a fin is inserted along a groove and fastened to a predetermined position. The fin can be tightly attached, thus being difficult to separate from the board.

That is, while the structure is not classified as the group of structures which rely on screw fixing of the fin, the fin is nonetheless tightly inserted in the recess portion in order to prevent the fin from dislodging unnecessarily when in use and fixed in place in the groove.

As a result, the fin is tightly fitted thereto in order to prevent its dislodgement. Thus, it is unlikely that the fin readily comes off the board just by the impact of a collision or the like, e.g., with a human body.

That is, under this impact, the fin comes off only when the impact is applied in a particular specific direction. However, even if the impact is from the direction in which the fin comes off, the fin just moves a small amount and will stop after such movement. As a result, the damage to the human body from the fin at the time of contact cannot be prevented.

The fin disclosed in Japanese Unexamined Patent Publication (Kokai) No. 2006-280839 is similarly inserted into the groove, and moved along the groove to be attached.

In this case, it is necessary to attach or detach the fin in accordance with the insertion procedure. For an unexpected impact, however, the fin is unlikely to come off when in use as long as the fin does not suffer an impact in a specified direction.

Consequently, when the fin comes into contact with human body, there is a high possibility that the fin remains attached to the board causing injury to the human body.

In the configuration shown in Japanese Publication of Patent Application No. 2003-528003, a C-shaped clamp is used to fasten the fin to the fin box as a locking member. That is, the fin is tightly fitted to the clamp in a so-called fin box. A large force is required to detach the fin and at the same time, it is difficult to detach the fin unless the fin is pulled out in a given direction relative to the fin box.

Consequently, an impact that is applied when the fin comes into contact with a human body during surfboard use or an impact in a certain direction will not cause the fin to come off. Therefore the fin remains fastened to the surfboard.

Furthermore, there arises another need, such that the accuracy at the time of attachment is required. That is, at least the slot must be matched or the fin must be inserted tightly into the clamp.

According to Japanese Publication of Patent Application No. 2005-508798, a cam is rotated by the worm gears in order to fix the fin to the surfboard. Therefore, the rotation of the worm gears is necessary for attaching/detaching the fin. The fin is thus fastened to the board and is unlikely to separate from the board by impact when in use.

Consequently, it is not possible to dislodge the fin in an emergency.

Japanese Publication of Patent Application No. 2005-526664 discloses a tag pin that is placed in a pin slot and tightened by a club screw. The fin is thus fastened tightly thereto, but the fin is unlikely to be dislodged and separate from the board in an emergency.

Furthermore, according to Japanese Unexamined Patent Publication (Kokai) No. 2007-160969, the fin can be attached easily, but its attachment is done by inserting the fin in an obliquely backward direction. If a screw is not used to fix the fin, there is a possibility that the fin comes off only when a force is applied from a given direction in an emergency.

Consequently, when the fin comes into contact with a human body from a variety of unexpected directions, that is, when the fin comes into contact with a human body during use of the surfboard, the fin remains almost in the fixed state. Therefore, contact with human body without the possibility of injury cannot be achieved.

As described above, a certain fin attachment structure is desired, which causes the fin to readily come off so as to prevent injury to a human body, that is, which causes the fin to come off the surfboard in a safe manner when in use.

Furthermore, it is originally required for the fin to be attached tightly to the surfboard without abruptly coming off other than in an emergency such as at the time of contact.

Still furthermore, as shown in the prior art, the attachment structure needs to be of a type in which the fin can be attached/detached readily for replacement and is fastened securely to the surfboard.

In addition, when the fin is attached to the board, there will inevitably be a space between the fin and the groove of the board.

That is, if this space is eliminated, at the time of attachment/detachment of the fin, the fin is rubbed throughout the entire groove, thus being hard to be attached or detached.

Therefore, although there inevitably exits a little space, at the time of being attached, this space will cause the fin to rattle.

In the case of the repetition of the attachment/detachment, or in the case of the use of an arbitrary fin with respect to a board based on the preference of a user, or the like, this space inevitably becomes larger. Such a problem must also be properly dealt with.

In particular, as well as regarding a fin that is readily detachable, also regarding a fin to be screwed and fixed, the rattle that may occur between the fin and the groove may cause instability at the time of take-off during normal usage. This fin rattle may further result in the reduction of operability. Some solutions to this problem are thus needed.

Conventionally, either paper or vinyl is forced into the space between the fin and the groove as a filler, or a gum tape or a cloth tape is wound around the fin to fill the space, these methods actually in practice result in a larger space. Additionally it can be difficult to attach or detach the fin by use of such fillers.

Thus, some methods as a solution to such problems have been desired.

SUMMARY

The present invention has been devised to solve all such problems.

According to some embodiment, the invention provides a fin to be attached to a groove in a bottom surface of a surfboard, the fin comprising a hollow part at a side surface of an attachment base portion of the fin, wherein a ball part is biased outwardly of the hollow part by an elastic member in the hollow part; and wherein by attachment of the fin in a groove of the surfboard, the ball part in the hollow part of the attachment base portion of the fin is moved into the hollow part against a biasing force from the elastic member. Thus the fin can be detachably mounted in the groove under an elastic compression force, which enables to solve the problems with such construction.

It is preferable according to some embodiments of the fin, wherein there is provided an engaging part including a hook slot for engagment with a fastener including a pin in the groove of the surfboard in one end direction of the attachment base portion of the fin. The hollow part is formed in the other end direction of the attachment base portion of the fin and at the side surface of the attachment base portion.

In these cases, it may be preferable that the fin include a hollow part having the ball part biased by an elastic member which is formed on both sides of the fin. Alternatively, it may be preferable for the fin to include a hollow part having the ball part biased by the elastic member which is formed at least at two or more portions at one side surface.

In some embodiments, it is preferable to use a fin wherein the hollow part extends across both side surfaces of the fin, and wherein there is disposed therein an elastic member that has the ball part at both end portions of the hollow part which biases it outwardly relative to the hollow part.

The ball part biased by the elastic member may be formed of a plunger, and the plunger may be mounted detachably in the hollow part of the attachment base portion of the fin.

the elastic member may be a coil spring, or at least a part of the ball part may be a spherical body. And further, it may be preferable to provide a fin wherein at least the length of the attachment base portion of the fin is smaller than the length of the groove of the surfboard, whereby with any fin, the problems noted previously can be solved.

According to some embodiments, it may be preferable for the fin to be attached to a groove in a bottom surface of a surfboard, wherein the fin at least comprises a hollow part at a side surface of an attachment base portion of the fin, wherein a non-slip member is mounted in the hollow part; and wherein the non-slip member is contained at its main body in the hollow part and has a non-slip part at a portion exposed to the outside of the hollow part which is sandwiched in a space between the attachment base portion of the fin and the fin attachment groove, thereby to provide non-slip effects.

Alternatively, it may be possible to provide the fin, wherein a non-slip member is mounted in the hollow part at a side surface of an attachment base portion of the fin to be attached to a groove in a bottom surface of a surfboard, and further, wherein the ball part biased by the elastic member is disposed in the same hollow part; and wherein by its biasing force, the attachment base portion of the fin is attached under elastic compression force, and the non-slip part can prevent fin rattle.

In addition, the non-slip member may be detachable. Further, a hollow part may be formed in one side surface of the fin in which the non-slip member is mounted. The hollow part may also be formed in both side surfaces of the fin in which the non-slip member is mounted, or the hollow part may be formed in the fin at two or more points for mounting the non-slip member.

The hollow part may also be formed so as to extend through the fin across to both side surfaces. The non-slip member having the non-slip part at both end portions of the hollow part may thus be mounted in the hollow part.

It may be preferable to use the fin to be attached to a groove in a bottom surface of a surfboard, wherein there are formed the hollow parts at least at two or more portions in the side surface of the attachment base portion of the fin, and the plunger formed of the ball part biased by the elastic member or/and the non-slip member having the non-slip part can be detachably mounted in the hollow part.

Because of such construction, it is possible to provide a fin in which an elastic member allowing the attachment/detachment of the fin is mounted in the fin itself. Such an attachment can be done tightly so there is no fin rattle.

Thus, the fin can be readily attached to a board, and can be detached.

In this case, at the time of being attached, the fin can be tightly attached by the ball part and the elastic member.

Furthermore, in the event that the fin contacts a human body during surfing, the fin will separate from the surfboard which thereby suppresses the impact thus minimizing potential injury to the human body.

Consequently, it is possible to provide a fin which is easily handled and which has high operational safety.

In addition, it is now possible to provide a fin which can be easily manufactured, and which has a considerably efficient structure.

Further, besides manufacturing of the fin having such construction, a conventional-type fin can also be improved or modified easily.

Further, the embodiments of the present invention may easily be applied to a fin having an attachment structure with a locking member of a pin.

Due to the fin having a ball part protruding under elastic compression on both sides of the fin, the fin can be fixed in a position elastically compressed with respect to both inner sides in the attachment groove of the board.

Furthermore, because the hollow part may be formed at two or more portions in one side surface of the fin, the fin can be fixed in position under the elastic compression in the well-balanced state in the fin attachment groove of the board.

In addition, the elastic member and the ball part can also be mounted in the hollow part having a through hole, which allows the elastic compression with respect to one side, for example, as well as the elastic compression to both sides if required.

The various embodiments of the present invention can be easily constructed also using various plungers in conformity with the hollow part.

An elastic member may employ a coil spring, and thus the attachment stability with the ball part or easy downsizing, or low costs can be achieved.

By making a part of the ball part a spherical body in case of, for example, the use in contact with the inner surface of the groove part of the board, point contact can be made and thus its easy attachment/detachment can be achieved.

In addition, if there is formed the recess portion in the groove of the board, a spherical shape can be fitted thereto and thus the attached state can be tightly maintained.

For example, if such spherical shape is formed in the contact direction with the coil spring, it is easy to be fitted in the hollow part at the central portion of the coil-like shape of the coil spring, which thus allows the stability of the attached state.

According to some embodiments, because of the fact that the length of the groove is large, play at both end portions is produced at the time the attachment base portion of the fin is attached/detached, thus enabling easy operation. In particular, in an emergency (such as in contact with a human body), the fin comes off the board more readily by virtue of such space, which thus enhances safety.

Instead of or in addition to the elastic member and the ball part, a non-slip member can be mounted in the hollow part and the space between the fin and the attachment groove of the board can be filled with the non-slip part of the non-slip member. This structure thus prevents fin rattle when the fin is attached.

Particularly, because of the fact that the non-slip part is formed at the exposed portion of the hollow part, the space between both of these structures can be filled with the non-slip part.

Furthermore, the non-slip member is detachable, which thus enables the mounting of an arbitrary non-slip member when required.

Non-slip effects at one side surface are thus achieved and non-slip effects on both sides can be obtained.

With the arrangements described above, the fin can be contacted with the side surface in the groove part of the board with the interposed non-slip part. This in turn prevents the fin from rattling in the groove part.

In addition, because of the fact that the hollow part for mounting the non-slip member may be provided at two or more positions, the non-slip members can likewise be mounted at two or more positions. Fin rattle can thus be prevented by the non-slip effects at such two or more positions, which thus improves fin stability when attached to the board.

By providing a through hollow part, the non-slip member having the non-slip part with respect to both inner side surfaces of the groove part can be mounted.

In addition, depending on the shape of the through hole, various shapes of non-slip members can be mounted.

The plunger and the non-slip member can be arbitrarily mounted in the hollow part of the attachment base portion of the fin.

DETAILED DESCRIPTION OF THE PREFERRED EMBODIMENTS

Figure 1:
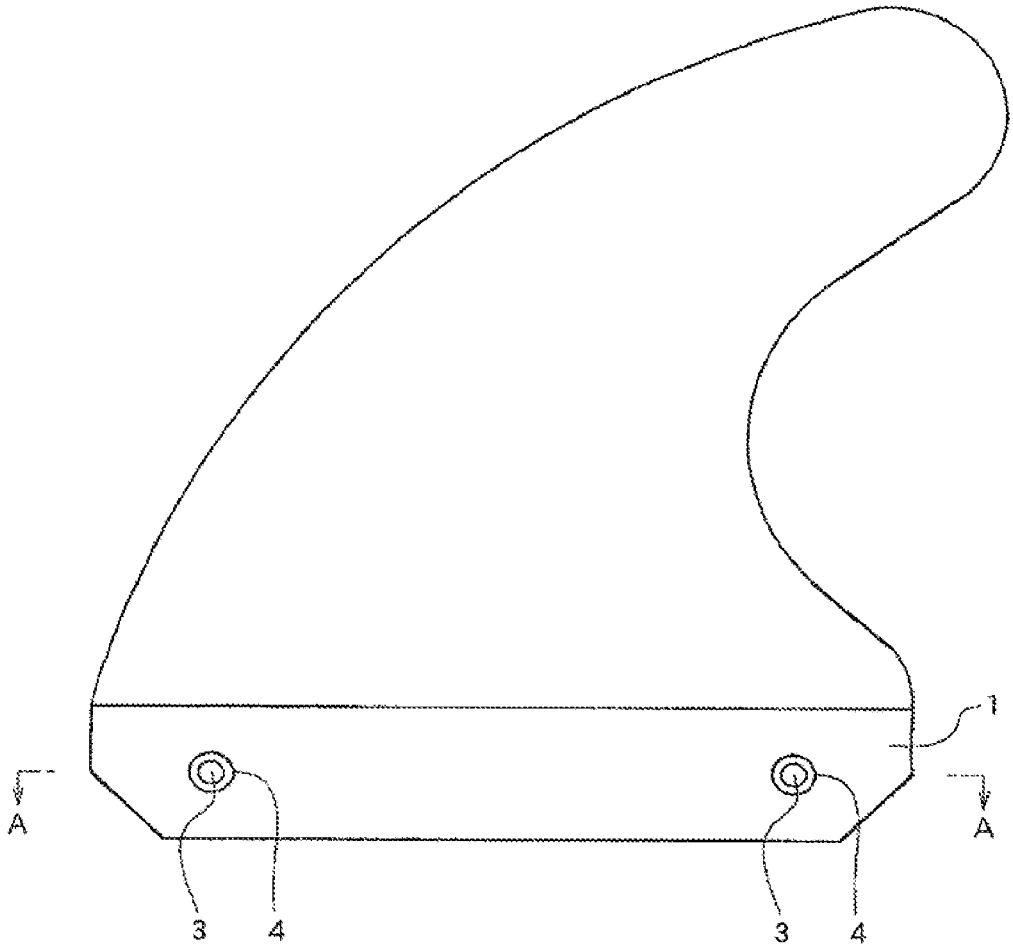
FIG. 1 is a view showing an example of a fin according to the present invention.

FIG. 1 is a basic example of a fin according to the present invention.

That is, there is provided a ball part 3 biased by a coil spring 2, at the side surface of an attachment base portion 1 of the fin.

The coil spring 2 and ball part 3 are mounted in a hollow part 4 that is formed in the side surface of the attachment base portion 1 of the fin. The coil spring 2 is disposed in the inner part and the ball part 3 is disposed on the outside.

As a matter of course, for example, a plunger may be used.

In this case, the ball part 3 is at least biased by the coil spring 2 in a state whereby the ball part 3 protrudes outwardly from the side surface of the attachment base portion 1 of the fin to be mounted.

That is, the ball part 3 is biased in the direction which causes it to protrude outwardly by means of the coil spring 2 from the opening of the hollow part 4.

Needless to say, the ball part 3 is disposed in such a way as to be located in a predetermined position using e.g., a crimp at the side edge portion of the hollow part 4 so it cannot easily be removed therefrom.

Figure 2:
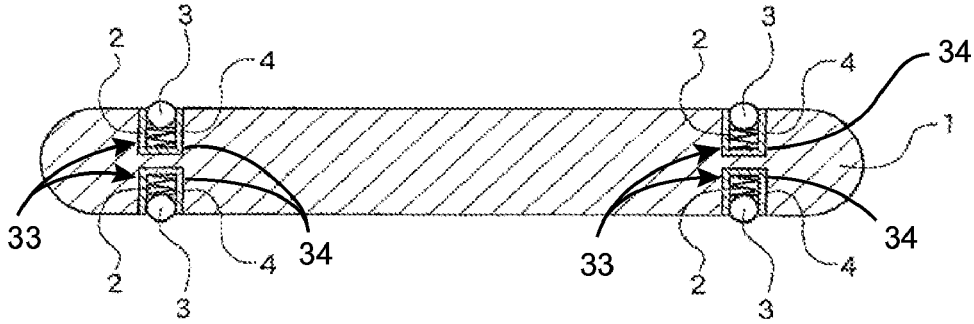
FIG. 2 is a cross-sectional view of an attachment base portion in an example of the fin according to FIG. 1.

The embodiment depicted in FIGS. 1 and 2 show an example in which opposed pairs of the ball parts are disposed at each side surface of the attachment base portion 1 of the fin.

Because of such construction, when the fin is mounted in a fin box 9, namely fin attachment groove 91 (see FIG. 3) which is provided in the bottom surface of a surfboard (not shown), at the time when the attachment base portion 1 of the fin is inserted into the attachment groove 91 of the board, the ball parts 3 biased by the coil spring 2 are pressed in the hollow part 4 of the attachment base portion 1 of the fin thereby enabling the attachment base portion 1 to be mounted in the groove 91 of the board. After attachment, the ball parts 3 are biased by the coil spring 2 and remain in the pressed state in the groove 91 of the board fin box 9.

Thus, when the fin is attached to the fin box 9 of a board, the ball parts 3 in the hollow part 4 of the attachment base portion 1 are moved into the hollow part 4 against the biasing force provided by the coil spring 2 thereby enabling quick mounting.

With the arrangement shown, the attachment base portion 1 of the fin can be maintained in a biased state within the groove 91 of the board, which thus prevents the fin from coming off unexpectedly.

The attachment base portion 1 of the fin can readily be attached or detached against elastic compression force from the ball part 3 biased by the coil spring 2. Thus no special efforts are required in order to attach/detach the fin and the board.

That is, the fin can be attached and detached by being forcefully fitted into and pulled out of the groove 91, respectively.

The ball parts 3 may be disposed on each side of the fin. Furthermore, respective pairs of the ball parts 3 may be positioned on both sides of the fin at opposed positions on both sides thereof.

In such an embodiment, the attachment base portion 1 of the fin has at least the same or shorter length as the attachment groove 91 of the bottom surface of the surfboard.

However, the longitudinal length of the groove 91 of the surfboard may be larger than the longitudinal length of the attachment base portion 1 of the fin. When the fin is attached, therefore, there are spaces in the front-and-rear direction of the groove part 91 thereby making the fin to be more easily attached/detached.

When fin detachment is relatively easy, for example, when an unusual force is applied to the fin during surfing, the force will cause the fin to be separated from the groove 91 of the board.

For example, should the fin strike a human body during surfing, the ball part 3 biased by the coil spring 2 is pressed into the hollow part 4 by the resulting unusual force thereby causing the fin to separate from the board. As a result, injury to the human body is minimized.

Consequently, even if the fin is unexpectedly brought into contact with a human body, the fin comes off by the force of contact, which thus prevents injury.

Because of the fact that the fin is anchored, for example, at two different positions within the groove 91, one pair of the ball parts 3 will may separate from the groove 91 while the other pair of the ball parts 3 is allowed to provide elastic compression. This functionality thus prevents the fin from unexpectedly coming off of the surfboard.

More particularly, when a force is applied in one direction, e.g., toward the front or toward the rear, the ball parts located most closely to that portion where this force is applied are most likely to be dislodged. The fin thus becomes easily rotatable with the other ball parts serving as a fulcrum. This in turn prevents loss of the fin.

W the fin is mounted in the groove 91 of the board having spaces in the front-and-rear direction of the attachment base portion 1 of the fin, a variety of further advantages are provided. By way of example, at the time of normal attachment/detachment, with the above-described spaces, the fin can be fitted in a state which is tilted in the front or rear direction.

Similarly the fin can be detached in a front or rear tilted state at the time of detachment as well.

There may be provided a spherical recess portion in conformity with the spherical surface of the ball part 3 at corresponding portions in the attachment groove 91 of the board, being biased portions of the ball part 3 at the time when the fin is attached.

With the arrangement, the ball part 3 of the fin can be tightly fitted and secured, and can be positioned precisely to be fixed in place.

FIG. 2 is a cross-sectional view along line A-A of FIG. 1, and a cross-sectional view of the attachment base portion 1 of the fin.

As shown in FIG. 2, the hollow parts 4 are each formed in opposite positions in the attachment base portion 1 of the fin, coil springs 2 are mounted in the hollow parts 4, and the ball parts 3 are disposed in the opening of the hollow parts 4.

With the arrangement, the ball part 3 for providing elastic compression on both sides of the fin can be disposed in a protruding manner.

The shape of the hollow part 4 as shown in the drawings just indicates one example, and is not limited to such shape.

In addition, a coil spring 2 is explicitly illustrated, but not limited thereto. Instead, the coil spring 2 only needs to be an elastic member 2 that can provide a biasing force in the opening direction, such as a resin material or rubber that has elasticity, or a plate spring or a spring member of other shapes, at least being one having such elastic compression so as to be capable of fixing the fin in the groove of a board.

Thus, an elastic member having a structure providing oil pressure, hydraulic pressure, or air pressure or other various elastic members capable of providing a biasing force are also embraced by the elastic member 2. Any elastic member 2 capable of providing a biasing force may be used.

Furthermore, the ball part 3 at least should be formed so as to have a protrusion shape at its contact surface with the inner side surface in the groove 91 of a board. The ball part 3 is thus not necessarily limited to a spherical shape.

Consequently, the shape at least having protruding parts is described to be the ball part 3 in this specification, and this ball part 3 is used in this context.

Furthermore, the drawings illustrate one embodiment wherein the ball parts 3 are disposed at two portions on either side surface of the attachment base portion 1 of the fin. The ball parts 3 may also be provided, for example, one on either side, or two or more on either side surface.

Alternatively, the invention is not limited to the case where the same number of ball parts 3 is provided on either side, Thus, different numbers of the ball parts 3 may be provided on both sides.

Further, although in the drawings, the ball parts 3 are provided on both sides at one portion, they may be provided in shifted positions, different from that which is depicted.

Figure 3:
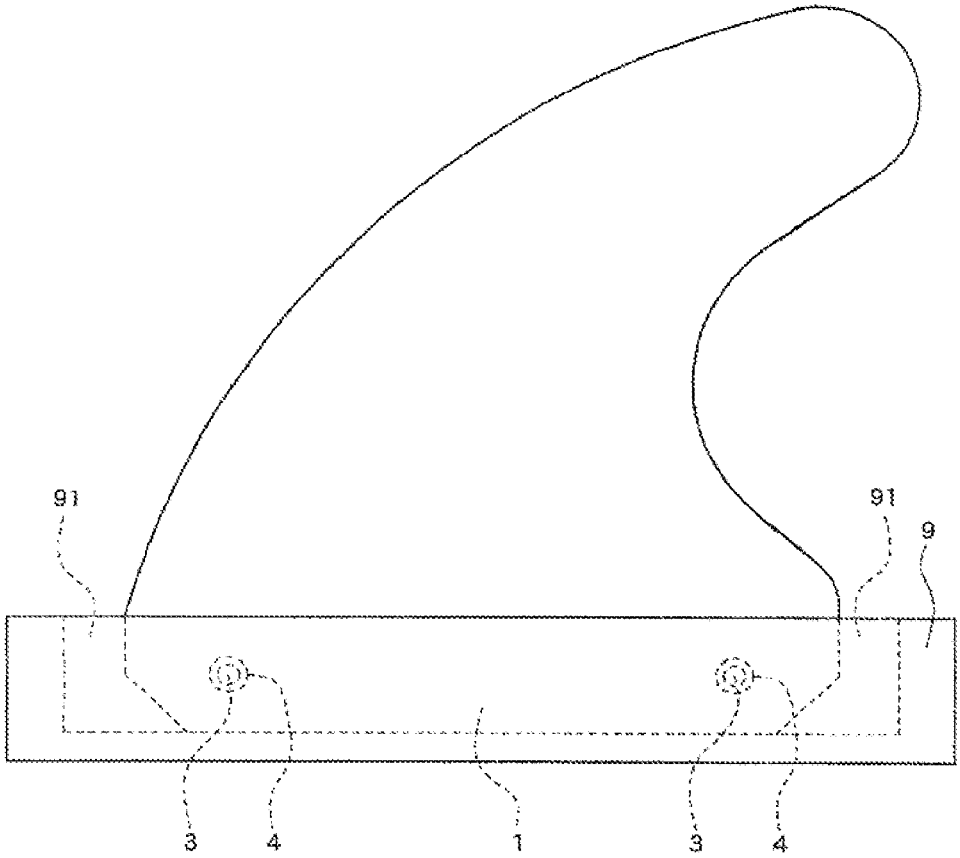
FIG. 3 is a view showing an example in the state in which the fin shown in FIG. 1 is attached to a fin box.

FIG. 3 is a view showing an example in the state where the fin shown in FIGS. 1 and 2 is mounted in a fin box that is the attachment groove 91 of a board.

As is shown in FIG. 3, the fin can be tightly attached.

Figure 4:
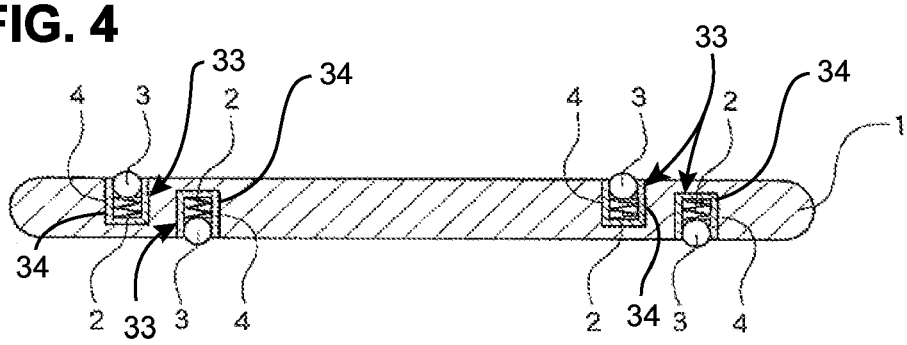
FIG. 4 is a cross-sectional view of an attachment base portion of the fin in another example of the fin according to the present invention.

FIG. 4 is a view showing another example of the fin according to the present invention, and a view showing an example of the cross-sectional view of the attachment base portion 1 of the fin.

More specifically, FIG. 4 is a view showing an example in which the hollow parts 4 are provided at two positions on either side of the attachment base portion 1 of the fin. A coil spring 2 and a ball part 3, biased by the coil spring 2, are provided in each hollow part so that the ball part 3 protrudes outwardly of the hollow part 4. Thus, the mounted positions of the ball parts 3 are provided on both sides in a shifted relationship to one another.

In the construction shown in FIG. 4, the fin can be tightly attached.

Figure 5:
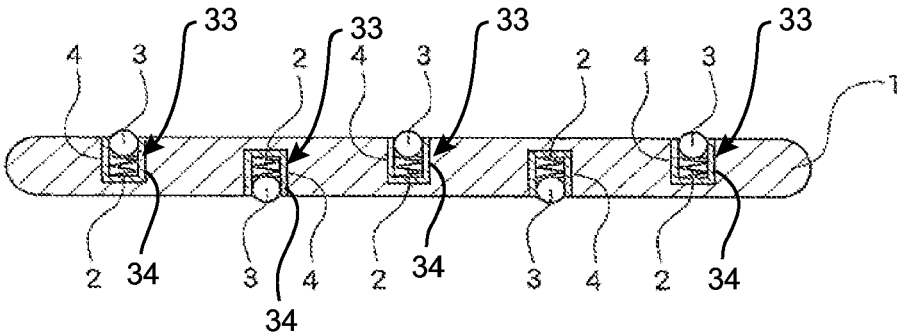
FIG. 5 is a cross-sectional view of an attachment base portion of the fin in another example of the fin according to the present invention.

FIG. 5 shows the cross-sectional view of another example of the fin according to the present invention, in which there are provided the hollow parts 4 at two points at one side surface and at three points at the other side surface. A coil spring 2 and a ball part 3 are respectively mounted to each of these hollow parts 4.

The hollow parts 4, coil springs 2 and ball parts 3 may be provided as may be required in any arbitrary number and/or positional arrangement.

Figure 6:
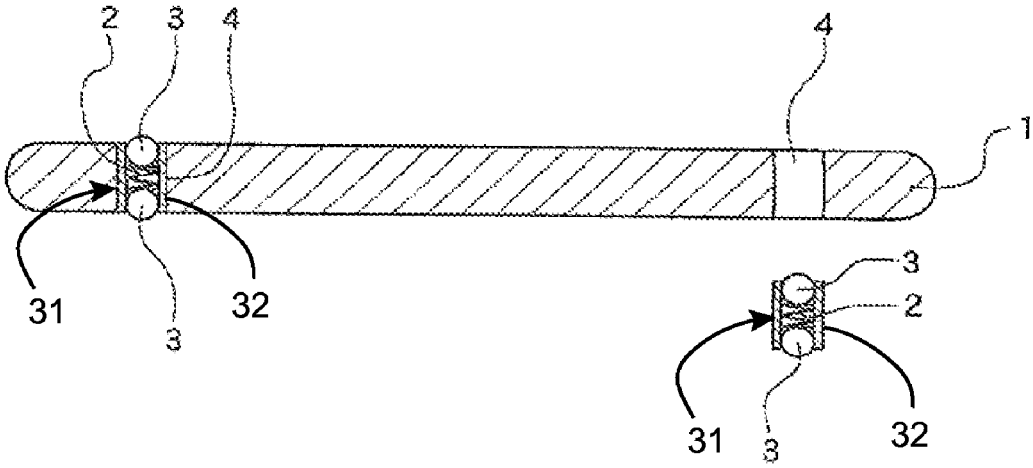
FIG. 6 is a cross-sectional view of an attachment base portion of the fin in another example of the fin according to the present invention.

FIG. 6 is a view showing another preferred example of the fin according to the present invention.

The construction shown in FIG. 6 is an example in which a hollow part 4 is formed entirely through the attachment base portion 1 of the fin so as to extend to each opposed side surface thereof. A plunger 31 comprised of a coil spring 2 and opposed pairs of ball parts 3 is thus provided in each hollow part 4.

The plunger 31 has the ball parts 3 each on both sides of a cylindrically-shaped tube 32 and has a coil spring 2 at its central portion. Each of the ball parts 3 is restricted to be in place by e.g., crimping so as not to come out of the cylindrical tube.

With such construction, a biasing force is provided by the ball parts 3 in both side directions.

The diameter of the tube 32 in which the coil spring 3 and ball parts 3 is provided has a diameter which can be inserted in the hollow part 4 of the attachment base portion 1 of the fin. The width from one ball part 3 to the other ball part 3 is somewhat larger than the length of the hollow part 4 extending through the attachment base portion 1 of the fin.

Therefore, by inserting the plunger 31 in the hollow part 4 of the fin, the ball parts 3 can be disposed so as to be biased in both side directions of the attachment base portion 1 of the fin.

In this case, the ball parts 3 need to protrude in the side surface direction more than the thickness of the fin.

With such construction, the plunger 31 can be mounted detachably in the hollow part 4 of the fin, and can be attached if required, or can be detached and used.

In addition, virtually any arbitrary plunger 31 having elasticity or a ball shape which is most suitable to a user can be made. Thus, the plunger 31 can be easily replaced at the time any defect occur.

One advantage that exists by forming the hollow part 4 in the attachment base portion 1 of the fin is that a plunger 31 can be attached without restriction to a general-purpose fin.

Thus, a variety of fins can be easily modified into the fin according to the present invention.

Figure 7:
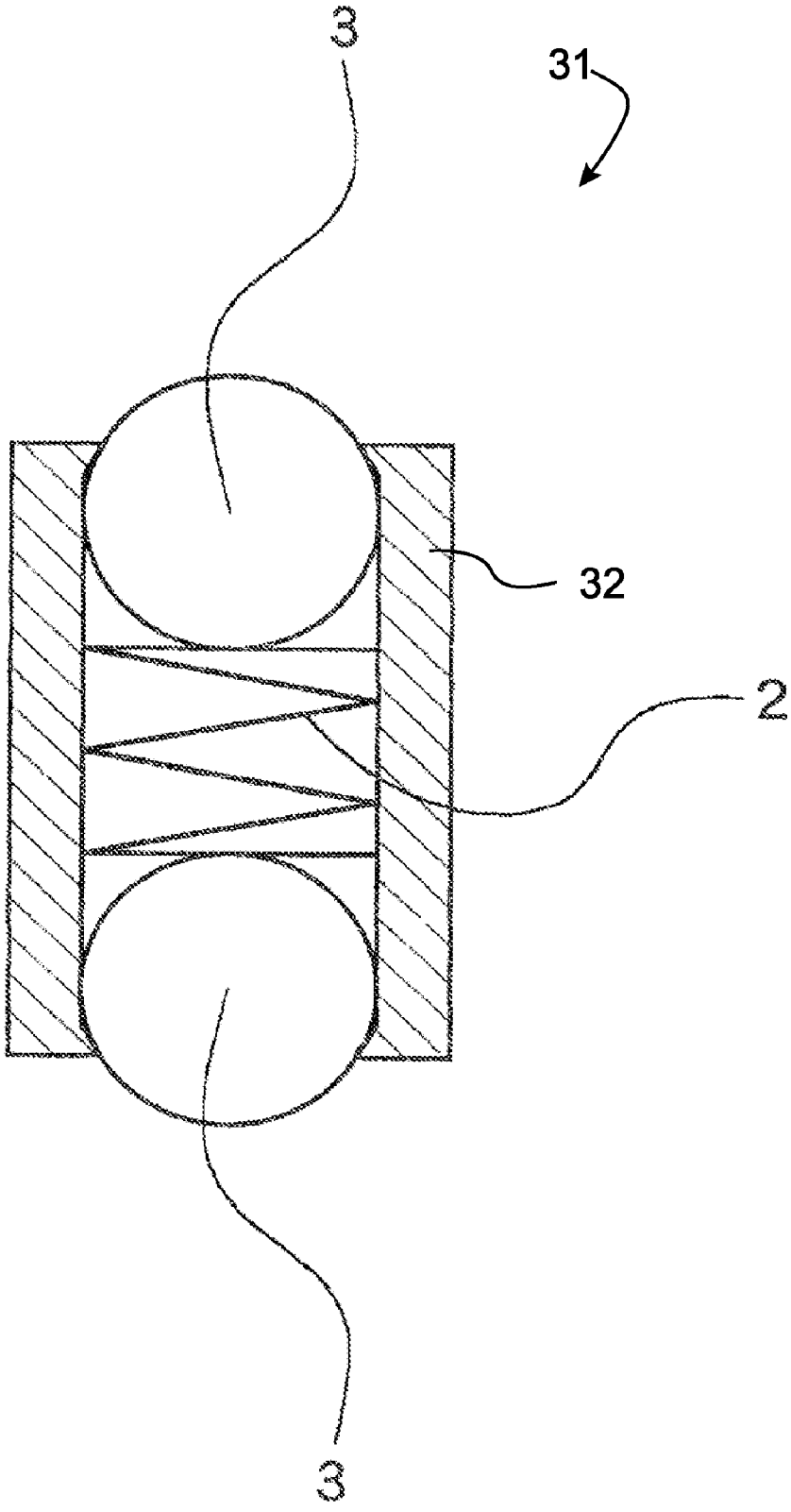
FIG. 7 is an enlarged view of a plunger shown in FIG. 6.

FIG. 7 is an enlarged view of the plunger 31 shown in FIG. 6. As shown, the plunger 31 includes ball parts 3 protrude outwardly from both sides of the cylindrical-shaped tube 32 with the coil spring 2 disposed therebetween at a central portion of the tube 32. The ball parts 3 are restricted in place, for example, by crimping so as not to come out of the cylindrical tube 32.

In this case, as mentioned above, various elastic members 2 may be used instead of the coil spring 2, and there has only to be the ball part 3 having protruding parts.

The diameter of the plunger 31 may be arbitrary. The plunger 31 must only be of a diameter which conforms to the diameter of the hollow part 4 of the attachment base portion 1 of the fin.

The length of the plunger tube 32 also only needs to be substantially the same as the thickness of the fin or to be shorter than such thickness. At least the ball parts 3 need only to be in a protruding state under elastic force from one side surface or both side surfaces at the time of being mounted in the hollow part 4.

The plunger 31, insofar as it could be disposed in this way, for example, may have a tube 32 which is longer than the thickness of the fin.

Figure 8:
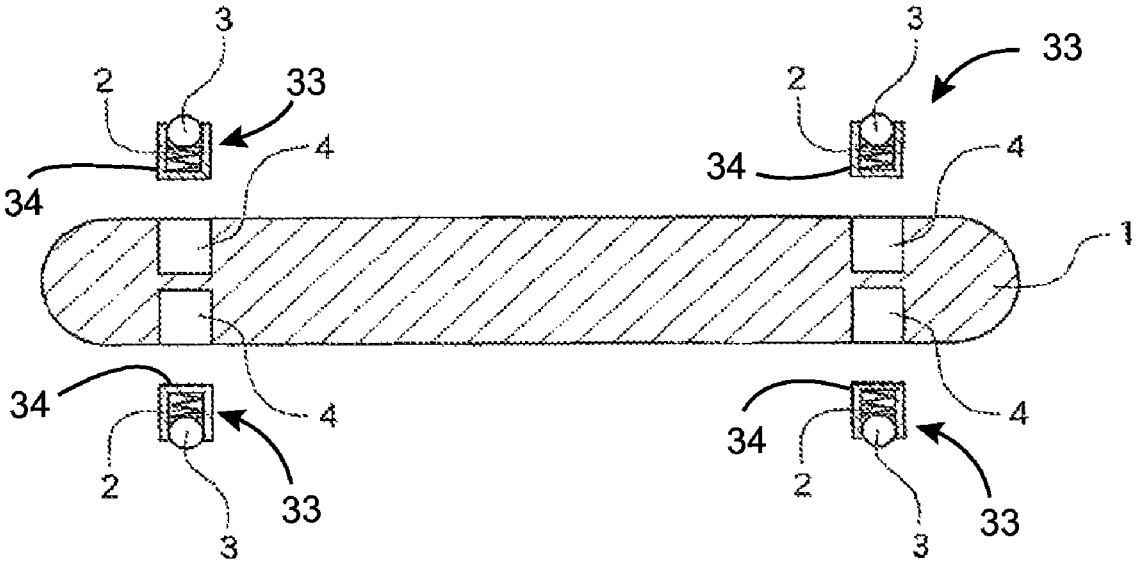
FIG. 8 is a cross-sectional view of an attachment base portion of the fin in another example of the fin according to the present invention.

FIG. 8 is a cross-sectional view of the attachment base portion 1 showing another example of the fin according to the present invention. As shown, each of the hollow parts 4 are formed having bottoms along both sides of the fin. A plunger 33 having a single ball part 3 only on one side thereof is mounted in each hollow part 4.

As to the construction shown in this drawing, a detachable plunger 33 having the ball part 3 biased by the coil spring 2 is used. The plunger 33 has a single ball part 3 only on one side, and the ball part 3 is biased by the coil spring 2 which is mounted in a cylindrical cup-shaped member 34.

Even if it is constructed in this way, the plunger 33 can be detachably mounted within a respective hollow part 4, and can be replaced by an arbitrary plunger 33 if needed.

Figure 9:
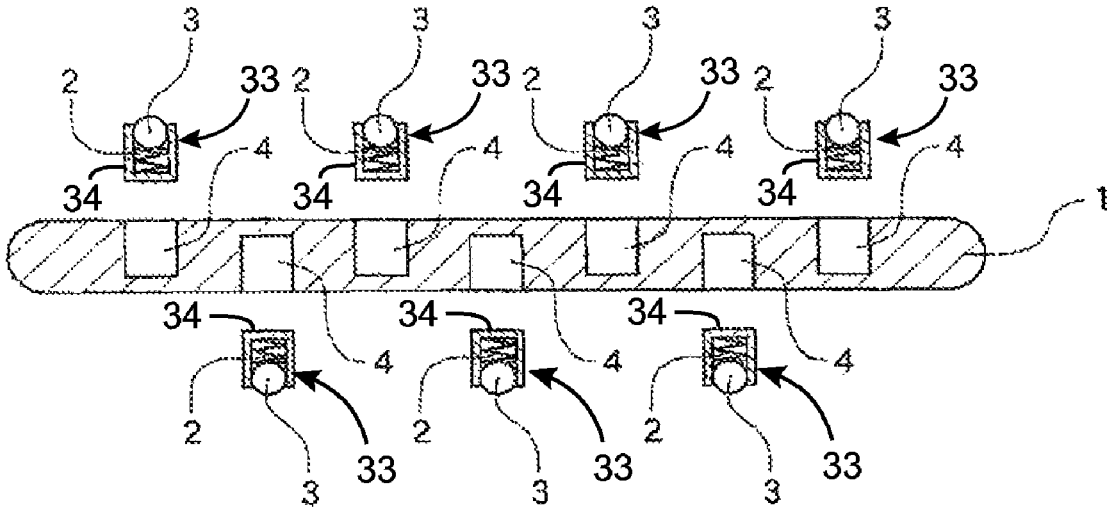
FIG. 9 is a cross-sectional view of an attachment base portion of the fin in another example of the fin according to the present invention.

FIG. 9 is a view showing an example similar to the construction shown in FIG. 8, but having different the positions of the hollow parts 4 of the attachment base portion 1 of the fin.

FIG. 9 thus shows an example in which the hollow parts 4 are formed in a staggered relationship relative to one another at four position at one side surface and at three portions at the other side surface of the attachment base portion 1 of the fin.

FIG. 9 shows an example of using the same plunger 33 as that employed in the embodiment depicted by FIG. 8.

Figure 10:
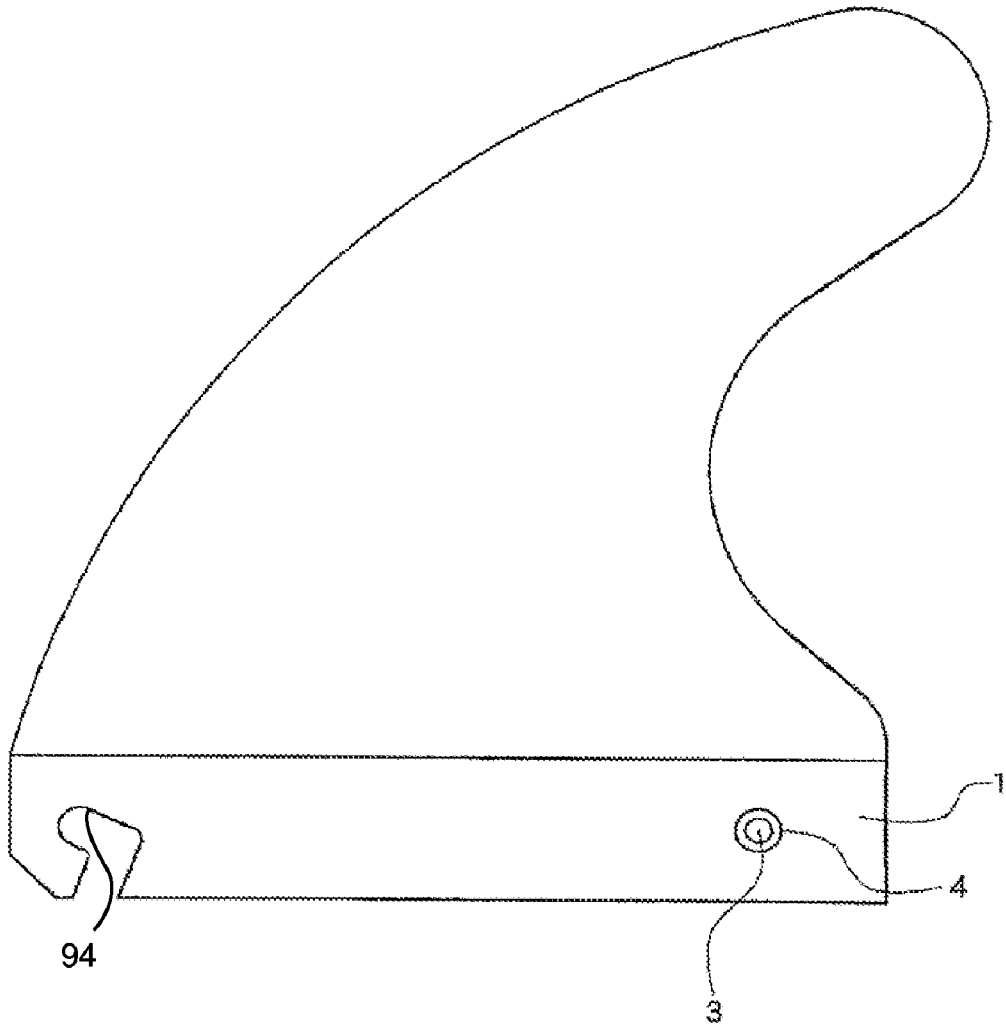
FIG. 10 is a view showing another example of the fin according to the present invention.

FIG. 10 is a view showing another example of the fin according to the present invention.

Figure 12:
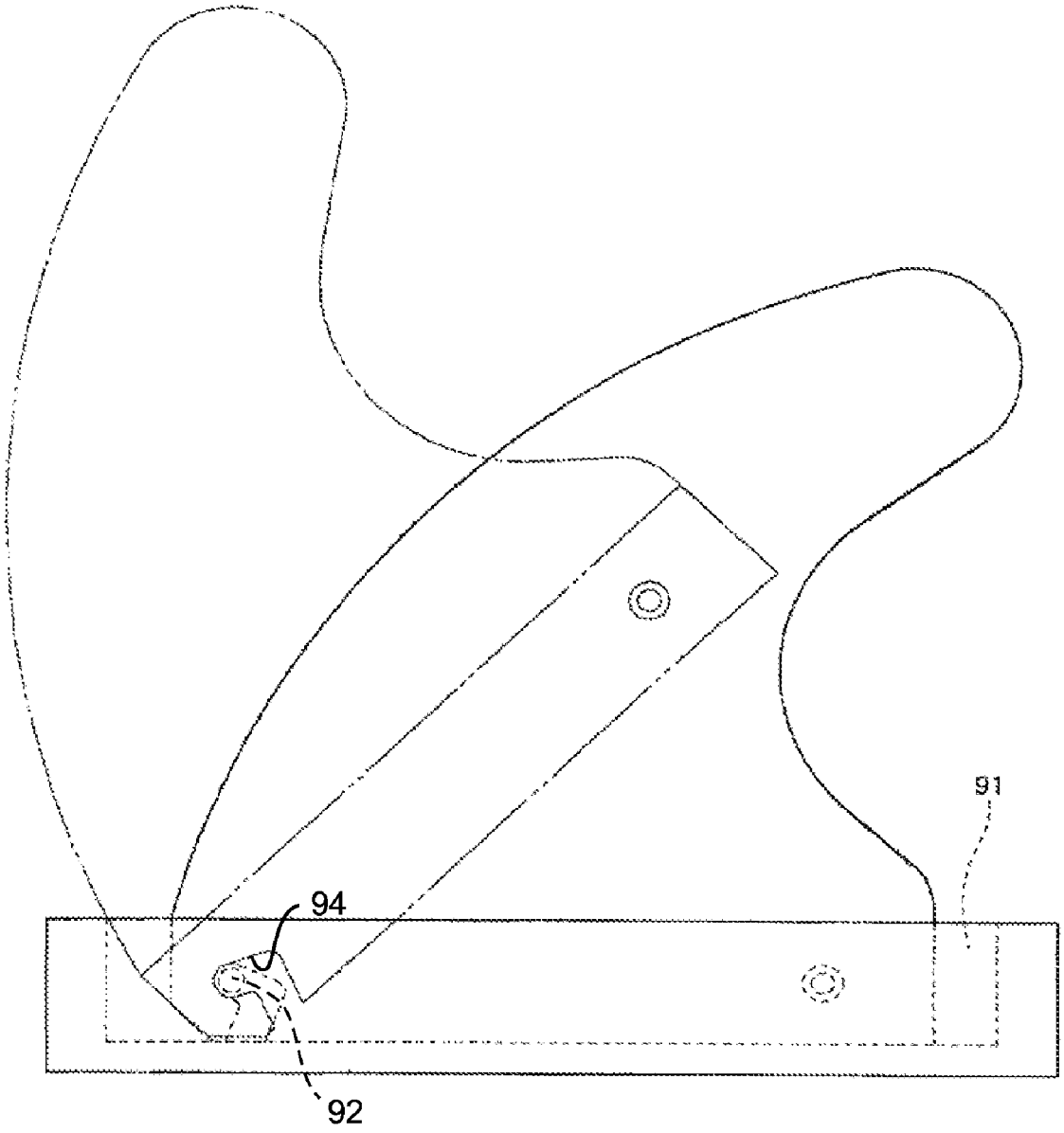
FIG. 12 is a view showing an example in the state in which the fin shown in FIG. 10 is attached to the fin box.

The fin in FIG. 10 is one which is adapted to engage a pin 92 provided in the fin attachment groove 91 of a fin box 9 in the bottom surface of a surfboard (see FIG. 12). That is, a hook slot 94 of the fin is hooked on the pin 92, thereby attaching the fin in the fin box 9.

In a conventional fin having a hook slot, the fin is fastened and fixed in place using other fasteners, for example, screws or other locking parts. However, in contrast to such conventional fin, in the construction shown in FIG. 10, a hollow part 4 and an elastic member, such as a coil spring and a ball part 3, are provided at an end of the attachment base portion 1 of the fin opposite to the hook slot 92. The fin is mounted in place and is elastically pressed in the fin box 9 by the spring-biased ball part 3.

In this case, a plunger 31 or 33 may be mounted in the hollow part 4, or a plunger 31 or 33 that is detachably mounted in the hollow part 4 may be configured.

With such construction, the fin can be readily attached or detached, and further, the fin will separate when a predetermined force is applied during an emergency.

Although the fin shown in this drawing is shaped to have a hook slot 94 at one end of the attachment base portion 1 of the fin, it may be of a type which has some other fastener for screwing, for example. Also, such a fastener structure may be provided at the other end portion of the fin.

Furthermore, the fin may be of construction in which there is provided at the attachment base portion of the fin, a locking part such as a pin member. In such a case, there is formed in the fin box 9 or the board main body, a groove part composed of a conducting path that conducts the pin so as to be able to move to a predetermined position.

Incidentally, although according to the present invention, the attachment base portion 1 of the fin is described to be attached to the fin box 9, that is the fin attachment groove 91 which is formed at the bottom surface of the surfboard, the present invention is also applicable to, for example, the one in which the groove 91 is formed in the bottom surface of the surfboard and the fin is directly attached.

Therefore, the construction according to the present invention, other than the one in which a fin box 9 is provided, is applicable specifically to a surfboard in which the groove 91 is formed directly in the bottom surface thereof.

Figure 11:
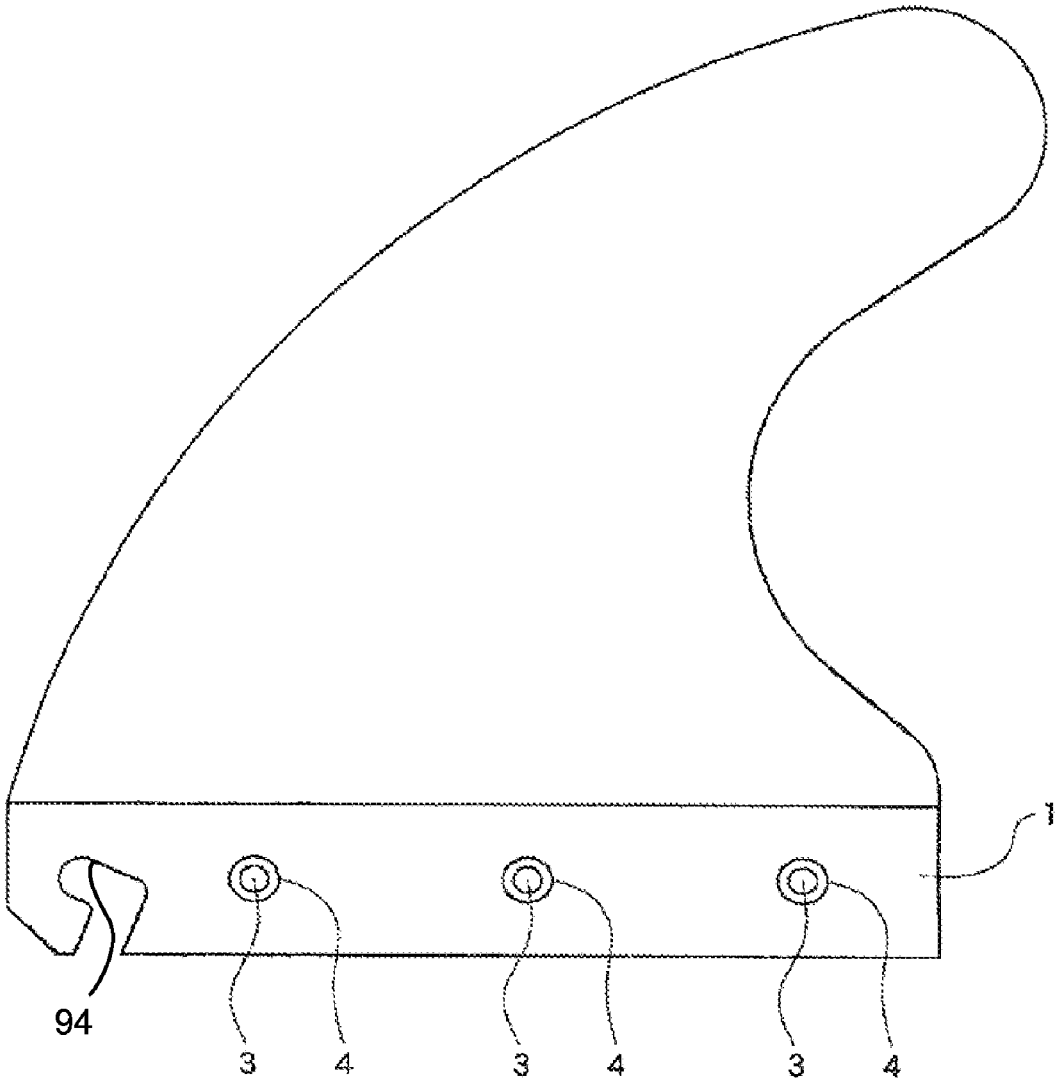
FIG. 11 is a view showing another example of the fin according to the present invention.

FIG. 11 is a view showing another example of the fin according to the present invention, and a view showing an example in which there are provided the hollow part 4, the ball parts 3 and respective elastic members 2 at three portions at one side surface of the fin.

(The elastic members 2 are mounted in the hollow parts 4 and are thus not shown in detail in FIG. 11.)

In FIG. 11, the hollow parts 4 and the like of the attachment base portion 1 of the fin may be provided at arbitrary positions and in arbitrary numbers.

FIG. 12 is a view showing an example when the fin shown in FIG. 10 is attached to the fin box 9, in which the hook slot 94 of the attachment base portion 1 of the fin is hooked on the pin 92 of the fin box 9. The fin is fixed in position so as to be elastically pressed in the fin box 9 by the hollow part 4, the coil spring 2 and the ball part 3 at the other end of the fin opposite to the hook slot 94.

In this case, for example, when the fin is lifted up from the rear, as indicated by the chain line, the fin is released from its elastically pressed position by the ball part 3 and is rotated about the axis of the pin 92 on which the hook slot 94 to thereby be disengaged.

On the contrary, in the state in which the hook slot 94 is hooked on the pin 92 and wherein the other end of the fin is pressed in the groove 91 of the fin box 9, the fin can be readily attached.

When an unexpected force is applied from the rear of the fin, one end of the attachment base portion 1 of the fin is released against the elastic compression force from the ball part 3 and the rear portion of the fin comes off the fin box 9. During such an occurrence, however, the fin remains attached to the board by virtue of the engagement of the hook slot 94 being hooked on the pin 92.

That is, although the rear portion of the fin is pulled out of the groove 91, the pin 92 is still engaged in the hook slot 94 in the front of the fin. Thus, the fin is caught by the board in the state of being rotated in the forward direction.

That is, in the contact state from the rear of the fin in which particularly the fin is much likely to be in contact with a human body, that is in the state in which a force from the rear of the fin is applied, the fin is released from being caught by the ball parts 3, and the force from the rear of the fin is converted into rotational force with the pin 92 hooked in the hook slot 94 of the fin as an axial center.

Consequently, even if the fin strikes a human body, the fin comes off, turns forward and backward, and thus the contact state with the human body can be avoided, which alleviates the impact without injury to the human body.

As described above, although the fin according to the present invention is variously usable and extremely easy to use, it is preferable that there is formed, for example, a fin in which there are provided only on one side surface of the attachment base portion 1 of the fin the hollow part 4, the elastic member 2 such as a coil spring and the ball part 3.

For example, it is preferable to be of construction in which there is provided on one side surface a member having elasticity such as rubber or the like, and at least with which one side surface of the attachment portion of the fin is inserted and supported in the fin box; and in which the attachment base portion of the fin is fixed in position elastically pressed by the ball part 3 on the other side surface.

In addition, it is preferable that there is formed a recess portion in which the ball part is fitted in a position on the inner surface of the fin box, that is the fin attachment groove 91, provided at the bottom surface of the surfboard, which position corresponds to that of the ball part 3 disposed in the hollow part 4 of the attachment base portion 1 of the fin.

With such a construction, the ball part 3 is tightly fitted therein, and thus a more tightly mounted state can be maintained.

On the other hand, in an emergency or at the time of detachment, the fin can be detached.

Further, even in the construction of this attachment base portion of a fin or in a normal composition, in many cases, the fin is moved.

Figure 13:
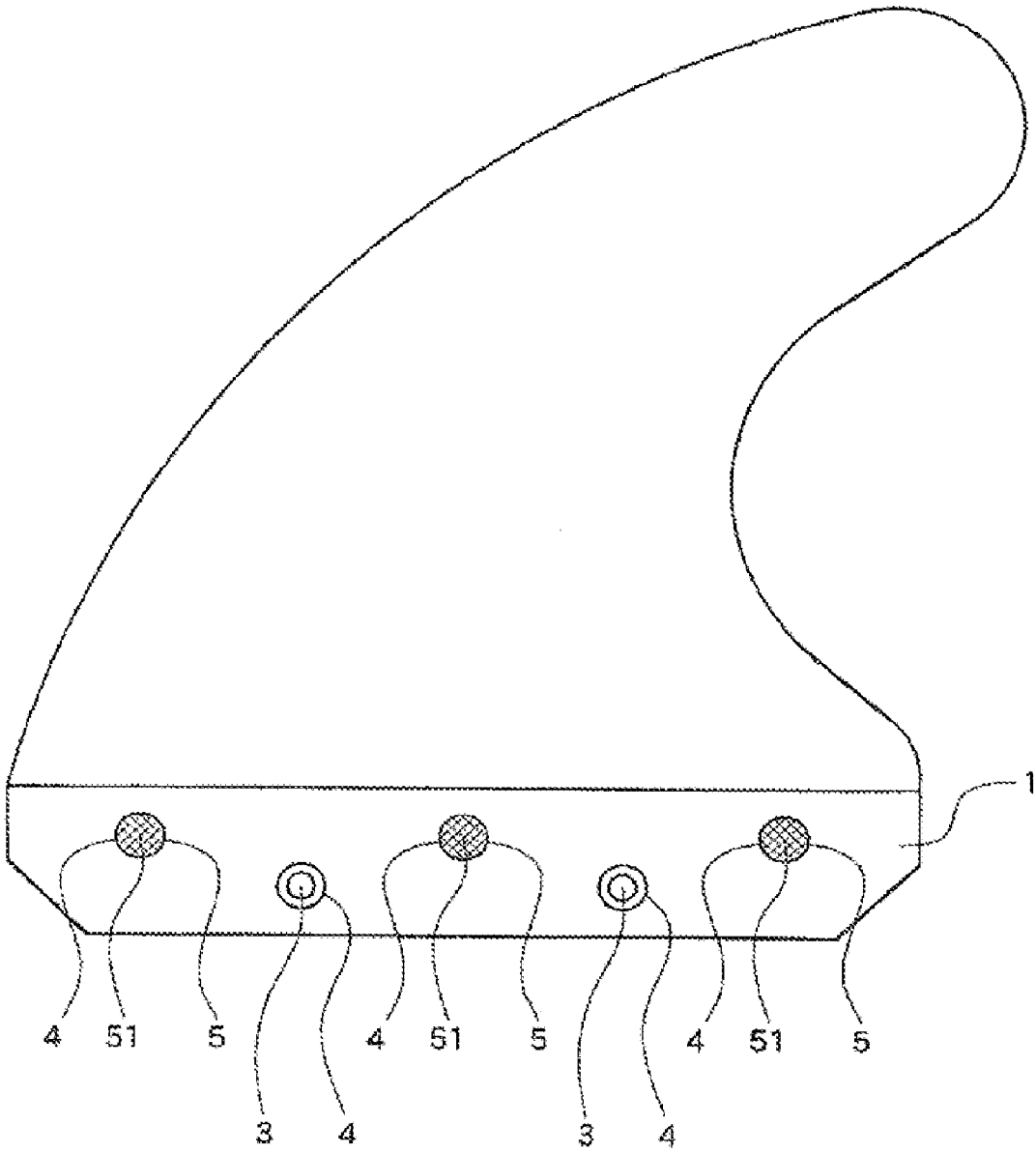
FIG. 13 is a view showing another example of the fin according to the present invention.

Thus, as shown in FIG. 13, it is preferable that a hollow part 4 be formed in the attachment base portion 1 of the fin, with a non-slip member 5 being mounted in the hollow part 4.

That is, the non-slip member 5 having a non-slip part 51 at a face portion thereof which protrudes outwardly from the hollow part 4. The protruding non-slip part 51 thus provides non-slip frictional resistance effects between the attachment base portion 1 of the fin and the corresponding surface of the groove 91 part for attachment of the fin. Such frictional resistance effects achieved by the non-slip part 51 thereby prevents the fin from rattling.

The hollow part 4 is formed in the attachment base portion 1 of the fin. A non-slip member 5 having the non-slip part 51 in a position protruding outwardly from the hollow part 4 is mounted in the hollow part 4. Thus, the fin can be easily brought into a tightly attached state.

In this case, the hollow part 4 in which the non-slip member 5 is to be mounted has only to be of the same construction as that of the hollow part 4 in the attachment base portion 1 of the fin in which plungers 31 or 33 are to be mounted. The hollow part may, for example, be one having a through hollow part of a cylindrical tube shape, one having a bottom, one formed to be a hollow part of a triangular prism, a quadrangular prism or a polyhedral prism, or one having a hollow part of any other arbitrary shape.

At least, the hollow part 4, as in the case of the shape in which plungers are mounted and the ball part can be protruded, must only to be of a form in which the non-slip member 5 can be mounted and from which the non-slip part 51 can protrude outwardly.

With the construction, the non-slip member 5 can be easily mounted on the fin, and thus fin rattle can be prevented.

Furthermore, by making the non-slip member 5 detachable, the non-slip member 5 having a size most suitable for providing non-slip effects depending on the conditions or in the relation between a board and a fin can be provided.

The non-slip member 5 according to the present invention is preferably one which can be mounted in the hollow part 4 and which has a non-slip part 51 which protrudes outwardly from the hollow part 4 when the non-slip member is mounted thereto. The non-slip member is also preferably mounted to the hollow part 4 so that the non-slip part 51 is positioned between the attachment base portion 1 of the fin and the fin attachment groove 91. In such a manner, the non-slip member 5 can prevent fin rattle through frictional resistance of the non-slip part 51 between the attachment base portion 1 of the fin and the fin attachment groove 91.

In addition, more desirably, the non-slip member 5 is detachable in the hollow part 4, and can be replaced by the non-slip member 5 most suitable for preventing the rattle.

Furthermore, the non-slip member 5 can also be set to be of various sizes, for example, the non-slip part 51 can be set to be of a variety of arbitrary areas or shapes. Also, the non-slip member 5 with various structures of the non-slip part 51 will suffice.

For example, the non-slip part 51 may be one having a variety of arbitrary irregularities, one having an adhesive member, or one that is made of a member having elasticity.

For example, the non-slip part 51 may be formed of a resin material having elasticity. The surface of such a resin material may be formed of irregular shapes.

In addition, the non-slip part 51 of the non-slip member 5 has only to be constructed so as to be in a position which protrudes outwardly from the hollow part or in a position substantially at the end surface portion of the hollow part 4 at the time it is mounted in the hollow part 4.

The non-slip part 51 is at least mounted in the space between the attachment base portion 1 of the fin and the fin attachment groove 91 so as to be sandwiched between both of such structures, which thereby prevents fin rattle.

In this case, the non-slip member 5 may be mounted on both sides of the attachment base portion 1 of the fin or mounted only on one side thereof. Alternatively, the hollow part 4 is formed entirely through the attachment base portion 1, and the non-slip member 5 having a non-slip part 51 at both end surface portions thereof is mounted within the hollow part 4. In such a situation, the non-slip member serves to produce non-slip effects on both sides of the attachment base portion 1.

The non-slip member 5 is at least mounted in a hollow part 4 that is formed in the attachment base portion 1 of the fin such that the non-slip part 51 thereof is exposed to the outside of the hollow part 4 and is sandwiched in the space between the attachment base portion 1 of the fin and the fin attachment groove 91 so as produce non-slip effects. As such, the sandwiched non-slip part 51 prevents fin rattle.

Figure 14:
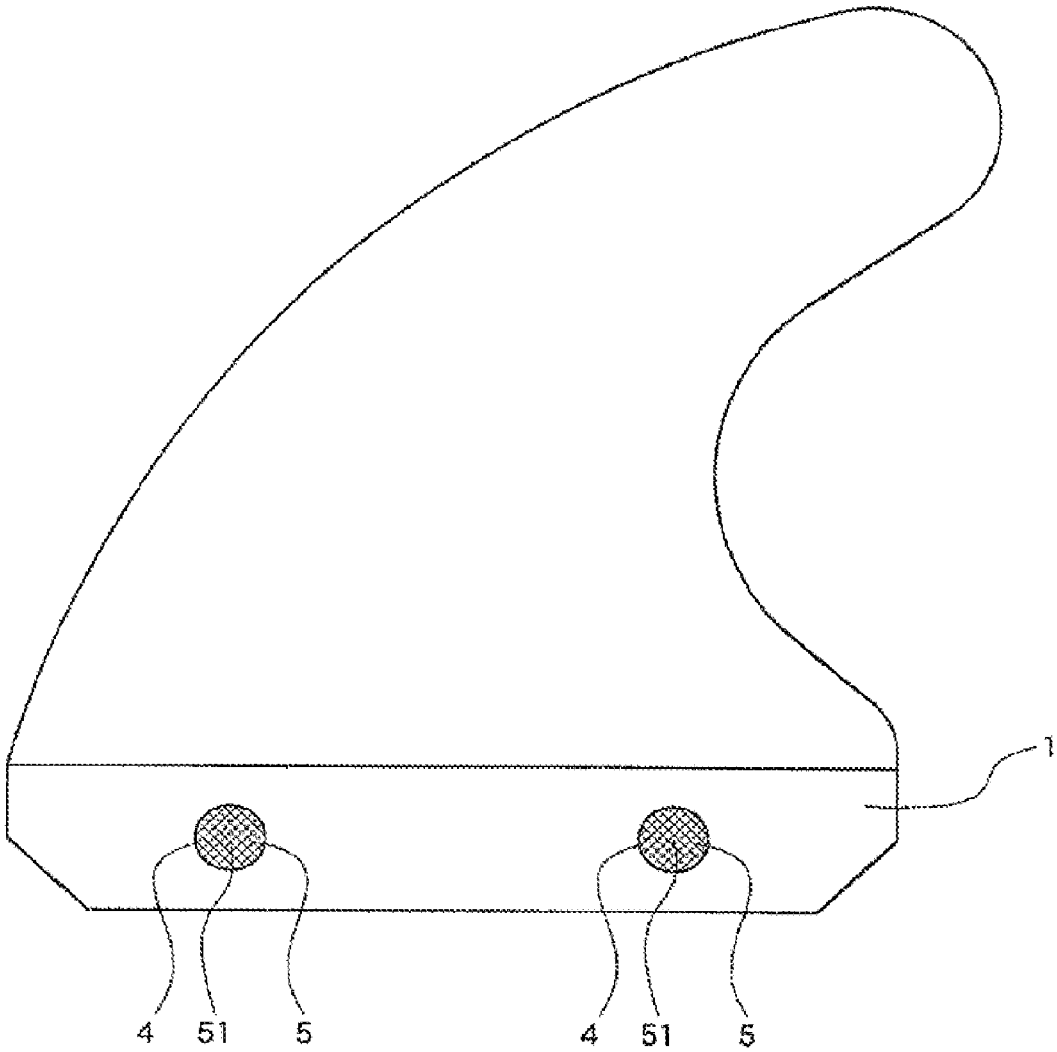
FIG. 14 is a view showing another example of the fin according to the present invention.

FIG. 14 is a view showing an example in which the hollow parts 4 are formed at two portions in one surface of the attachment base portion 1 of the fin, the non-slip member 5 having the non-slip part 51 is mounted in these hollow parts 4, and the non-slip part 51 protrudes outwardly from the side surface of the base portion 1.

With such construction, the space of the side surface of the fin can be made much smaller, which thus prevents fin rattle.

In particular, fins that are generally used can be provided with a hollow part 4 that is formed in the attachment base portion 1 of the fin. The non-slip member 5 having the non-slip part 51 may then be mounted in the hollow part 4, which thus prevents rattling of the fin.

In addition, by employing the detachable non-slip member 5, the optimum non-slip member 5 can be mounted depending on the daily surfing state, the state of the board and the like.

Figure 15:
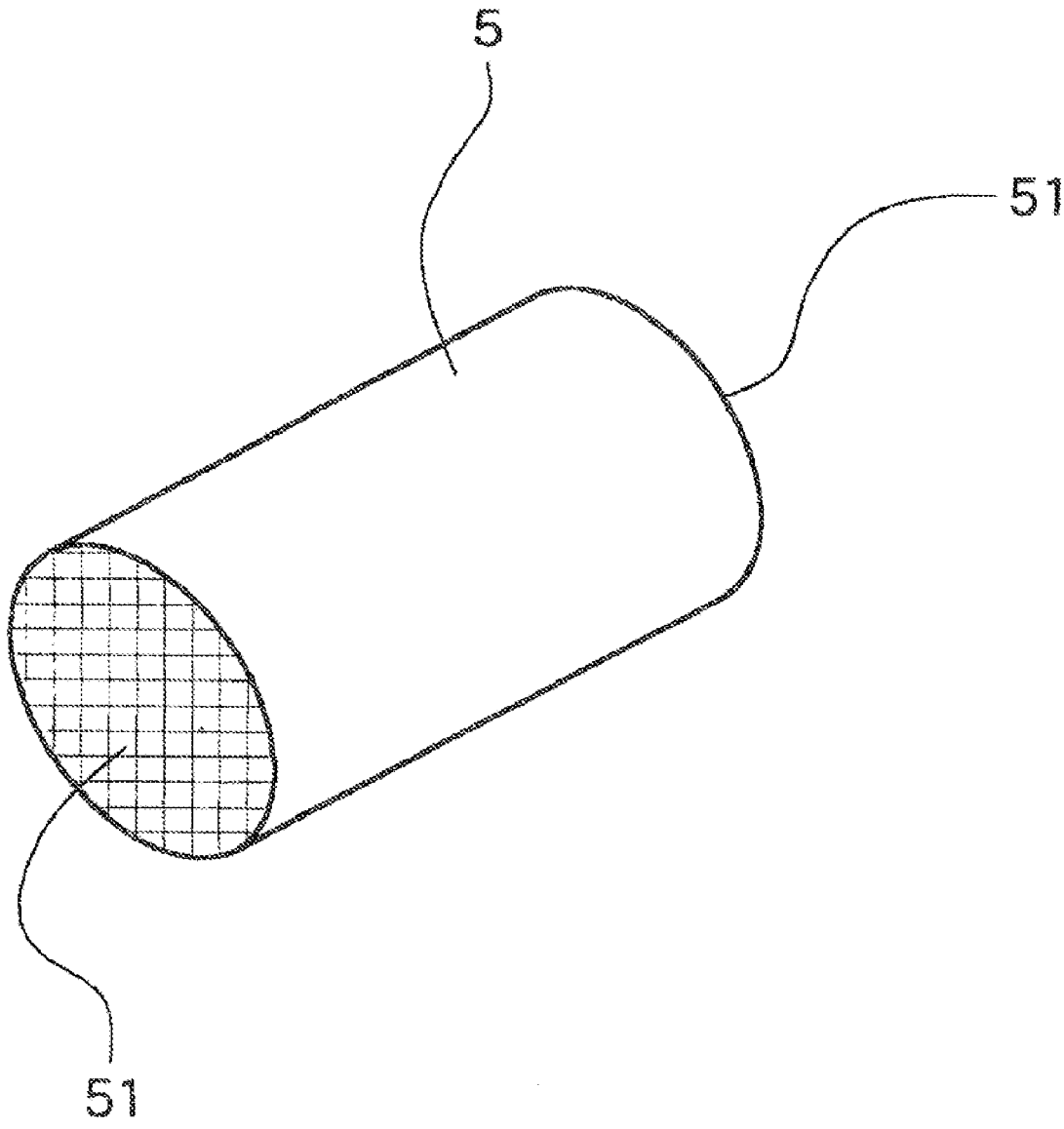
FIG. 15 is a view showing an example of a non-slip member to be detachably mounted in the fin.

FIG. 15 is a view showing an example of the detachable non-slip member 5 having the non-slip part 51 at both ends.

A non-slip member of various shape structures can be formed by e.g., the change of the size of the non-slip surface, or the change of the material or shape of the non-slip part, or the change of the length of the base portion providing connection therebetween. The degree of non-slip effects can be arbitrarily set, and the non-slip member can be implemented properly in the most suitable construction with respect to every fin.

Consequently, a fin having a non-slip member of extremely high applicability can be provided as well.

The invention claimed is:

1. A fin to be attached to a fin attachment groove formed in a bottom surface of a surfboard, the fin comprising:

an attachment base portion sized and configured to be received within the fin attachment groove in the bottom surface of the surfboard;

a plurality of hollow parts formed within at least one side surface of the attachment base portion of the fin, at least one plunger positioned within a first respective one of the hollow parts, the plunger comprising a ball part and an elastic member which biases the ball part outwardly of the hollow part for engagement with a first corresponding opposed surface portion of the groove when the attachment base portion is received therein so as to provide detachable mounting of the fin to the surfboard; and at least one non-slip member positioned within a second respective one of the hollow parts, the non-slip member comprising a main body portion sized and configured to be received within the hollow part, and a non-slip part at an exposed end face of the main body portion, wherein the non-slip part protrudes outwardly from the hollow part so to be sandwiched between the attachment base portion and the groove, the non-slip part being engaged with a second corresponding opposed surface portion of the groove when the attachment base portion is received therein, wherein the non-slip member is formed of a resin material providing frictional resistance with the second corresponding opposed surface portion of the groove against which the non-slip member is engaged so as to prevent fin rattling when the attachment base portion is detachably mounted to the fin attachment groove of the surfboard.

2. The fin according to claim 1, which includes an engaging part for engaging with a fastener in the fin attachment groove of the surfboard at one end of the attachment base portion 1 of the fin; and wherein at least one of the hollow parts and a corresponding plunger are provided at an opposite end of the attachment base portion of the fin and at a side surface of the attachment base portion.

3. The fin according to claim 1, wherein the hollow parts and a corresponding plunger are provided on both sides of the attachment base portion of the fin.

4. The fin according to claim 1, wherein the hollow parts and a corresponding plunger are provided at least at two or more positions at one side surface of the attachment base portion of the fin.

5. The fin according to claim 1, wherein selected ones of the hollow parts extend through the attachment base portion of the fin so as to be exposed at both side surfaces thereof, and wherein each of the selected ones of the hollow parts includes a plunger having an elastic member and a pair of ball parts which are biased outwardly of the hollow part in both end directions thereof.

6. The fin according to claim 1, wherein plunger is mounted detachably in the hollow part of the attachment base portion of the fin.

7. The fin according to claim 1, wherein the elastic member is a coil spring.

8. The fin according to claim 1, wherein at least a part of the ball part is a spherical body.

9. The fin according to claim 1, wherein the attachment base portion of the fin has a length which is smaller than a length of the fin attachment groove of the surfboard.

10. The fin according to claim 1, wherein the non-slip member is detachably mounted to a hollow part.

11. The fin according to claim 1, wherein one side surface of the fin includes a hollow part in which a respective non-slip member is mounted.

12. The fin according to claim 1, wherein both side surfaces of the fin include a hollow part in which a respective non-slip member is mounted.

13. The fin according to claim 1, wherein the hollow part in which the non-slip member is mounted is provided at two or more positions in the attachment base portion of the fin.

14. The fin according to claim 1, wherein at least one of the hollow parts extends through the attachment base portion of the fin so as to be exposed at both side surfaces thereof, and wherein the non-slip member includes a main body portion positioned within the at least one of the hollow parts, and non-slip parts at opposed end faces thereof.

15. The fin according to claim 1, which comprises a plurality of plungers and a plurality of non-slip members, and wherein the plurality of hollow parts is located at least at two or more positions in a side surface of the attachment base portion of the fin, and wherein each of the hollow parts of a first set thereof includes respective one of the plungers, and wherein each of the hollow parts of a second set thereof includes a respective one of the non-slip members, and wherein the plungers and non-slip members are detachably mounted within the hollow parts.

16. The fin according to claim 1, wherein resin material of the non-slip part at the exposed face of the non-slip member has an irregular shape.

17. The fin according to claim 1, wherein resin material of the non-slip part at the exposed face is an adhesive material.

18. The fin according to claim 1, wherein resin material of the non-slip part at the exposed face is an elastic material.

* * * * *